US007998003B2

(12) United States Patent
Orr

(10) Patent No.: US 7,998,003 B2
(45) Date of Patent: Aug. 16, 2011

(54) VOLLEYBALL PRACTICE SYSTEM

(75) Inventor: Troy J. Orr, Draper, UT (US)

(73) Assignee: Troy J. Orr, Draper, UT (US)

( * ) Notice: Subject to any disclaimer, the term of this patent is extended or adjusted under 35 U.S.C. 154(b) by 0 days.

(21) Appl. No.: 12/633,352

(22) Filed: Dec. 8, 2009

(65) Prior Publication Data

US 2011/0136594 A1 Jun. 9, 2011

(51) Int. Cl.
*A63B 69/00* (2006.01)

(52) U.S. Cl. ..... 473/426; 473/459; 473/473; 473/422; 473/423

(58) Field of Classification Search ..... 473/422, 473/423, 426, 427, 429, 430, 459, 473
See application file for complete search history.

(56) References Cited

U.S. PATENT DOCUMENTS

| | | | | | |
|---|---|---|---|---|---|
| 4,372,561 | A * | 2/1983 | Morgan et al. | ..... | 473/426 |
| 4,881,742 | A * | 11/1989 | Hargreave | ..... | 473/575 |
| 4,948,150 | A * | 8/1990 | Daly et al. | ..... | 473/430 |
| 5,957,781 | A * | 9/1999 | Kelly | ..... | 473/140 |
| 6,357,750 | B1 * | 3/2002 | Lievens | ..... | 273/395 |
| 6,672,979 | B2 * | 1/2004 | Brenneisen | ..... | 473/430 |
| 7,041,016 | B1 * | 5/2006 | Omtvedt | ..... | 473/426 |
| 7,824,282 | B2 * | 11/2010 | Wycoff | ..... | 473/473 |
| 2001/0003106 | A1 * | 6/2001 | Brenneisen | ..... | 473/430 |
| 2010/0009784 | A1 * | 1/2010 | Wycoff | ..... | 473/429 |

* cited by examiner

*Primary Examiner* — Raleigh W. Chiu

(57) ABSTRACT

A volleyball practice system that includes a support frame with an attached reduced size volleyball practice net, a catch net, a removable and selectively positionable suspended ball attached to the support frame by a plurality of tethers, and a selectively removable electronic speed sensor and indicator device attached to the support frame for indicating the speed of the volleyball as it travels transversely to a vertical planar surface of the practice net.

23 Claims, 19 Drawing Sheets

VOLLEYBALL PRACTICE SYSTEM

TECHNICAL FIELD

The present disclosure relates generally to the field of sports training equipment. More specifically, the present disclosure relates to a volleyball practice system.

BACKGROUND

Players on a volleyball team practice skills and techniques to improve their abilities and performance when competing in the sport of volleyball. Some skills in volleyball require several players to practice or require time to retrieve volleyballs after they are hit. Players must practice several ball-striking techniques to hone skills. Some practice is acquired during team practices, but many times further practice is desired outside of team practices. In these instances a player practicing the sport must collect balls they strike over a volleyball net and the ball may travel a considerable distance and must be retrieved, which wastes time. In addition, the player may not be able to practice striking the ball without the assistance of another player of considerable skill to set the ball in flight through the air to the desired position for striking.

BRIEF DESCRIPTION OF THE DRAWINGS

The present embodiments will become more fully apparent from the following description and appended claims, taken in conjunction with the accompanying drawings. Understanding that the accompanying drawings depict only typical embodiments, and are, therefore, not to be considered to be limiting of the disclosure's scope, the embodiments will be described and explained with specificity and detail in reference to the accompanying drawings.

DETAILED DESCRIPTION OF PREFERRED EMBODIMENTS

It will be readily understood that the components of the embodiments as generally described and illustrated in the figures herein could be arranged and designed in a wide variety of different configurations. Thus, the following more detailed description of various embodiments, as represented in the figures, is not intended to limit the scope of the disclosure, as claimed, but is merely representative of various embodiments. While the various aspects of the embodiments are presented in drawings, the drawings are not necessarily drawn to scale unless specifically indicated.

The phrases "connected to," "coupled to" and "in communication with" refer to any form of interaction between two or more entities, including mechanical, and electrical. Two components may be coupled to each other even though they are not in direct contact with each other. The term "abutting" refers to items that are in direct physical contact with each other, although the items may not necessarily be attached together.

Figure 1A:
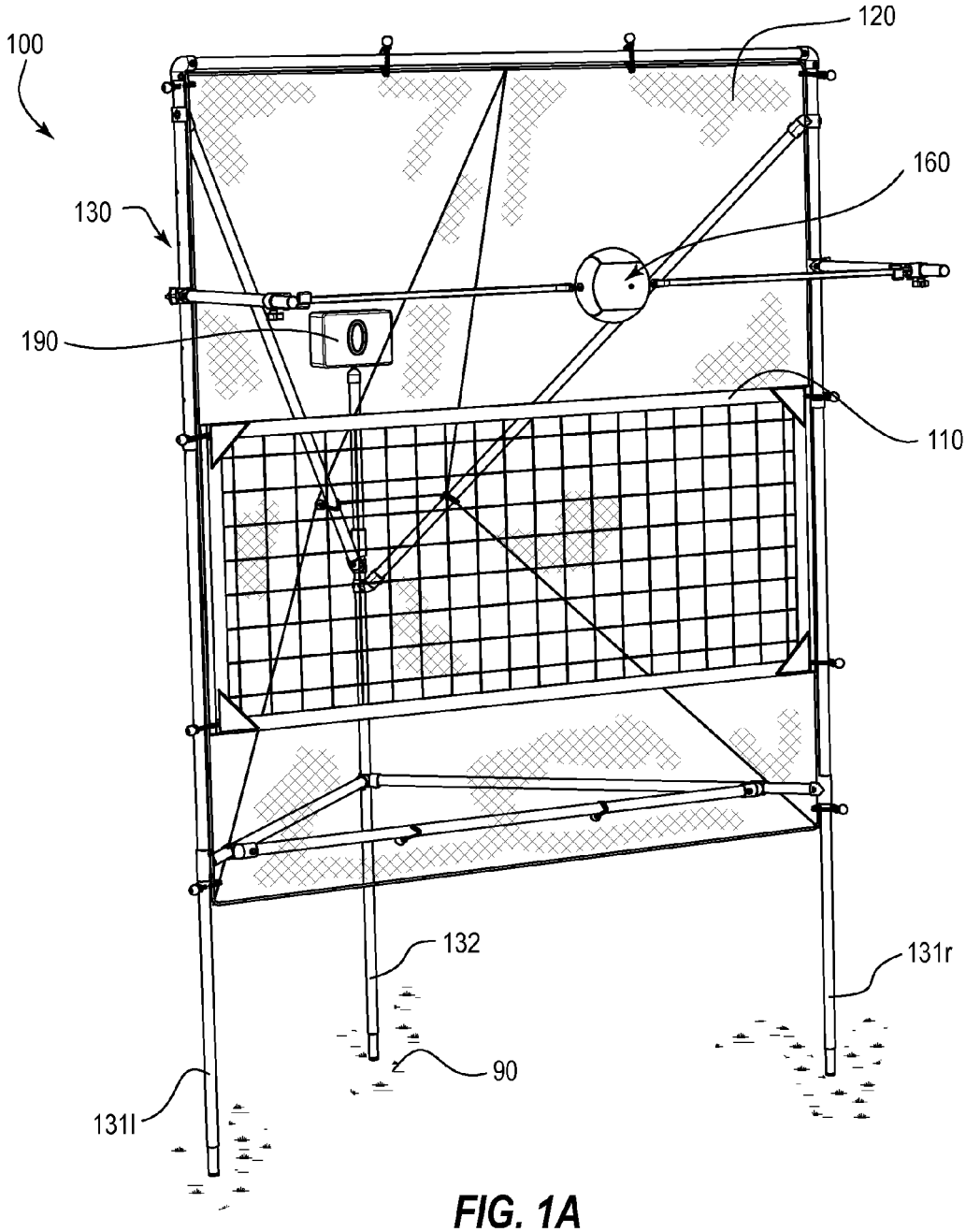
FIG. 1A is a perspective view of a volleyball hitting practice system.

FIG. 1A is a perspective view of a volleyball hitting practice system 100. The system 100 includes frame 130, practice net 110, catch net 120, suspended ball assembly 160, and speed sensor and indicator 190. The practice net 110 and catch net 120 are attached to frame 130. Left post 131*l*, right post 131*r*, and rear post 132 are located at the corners of frame 130 and can rest on or anchored to a horizontal surface 90. A suitable horizontal surface or ground may be grass, concrete, dirt, or a gymnasium floor. The system may be anchored to the ground using weights, fasteners, tie-downs, adhesion, or stakes. Suspended ball assembly 160 is selectively attached to frame 130. In one embodiment, the width of the volleyball practice system is about 8 feet, the height of the system is about 11 feet, and the depth of the system is about 5 feet.

Figure 1B:
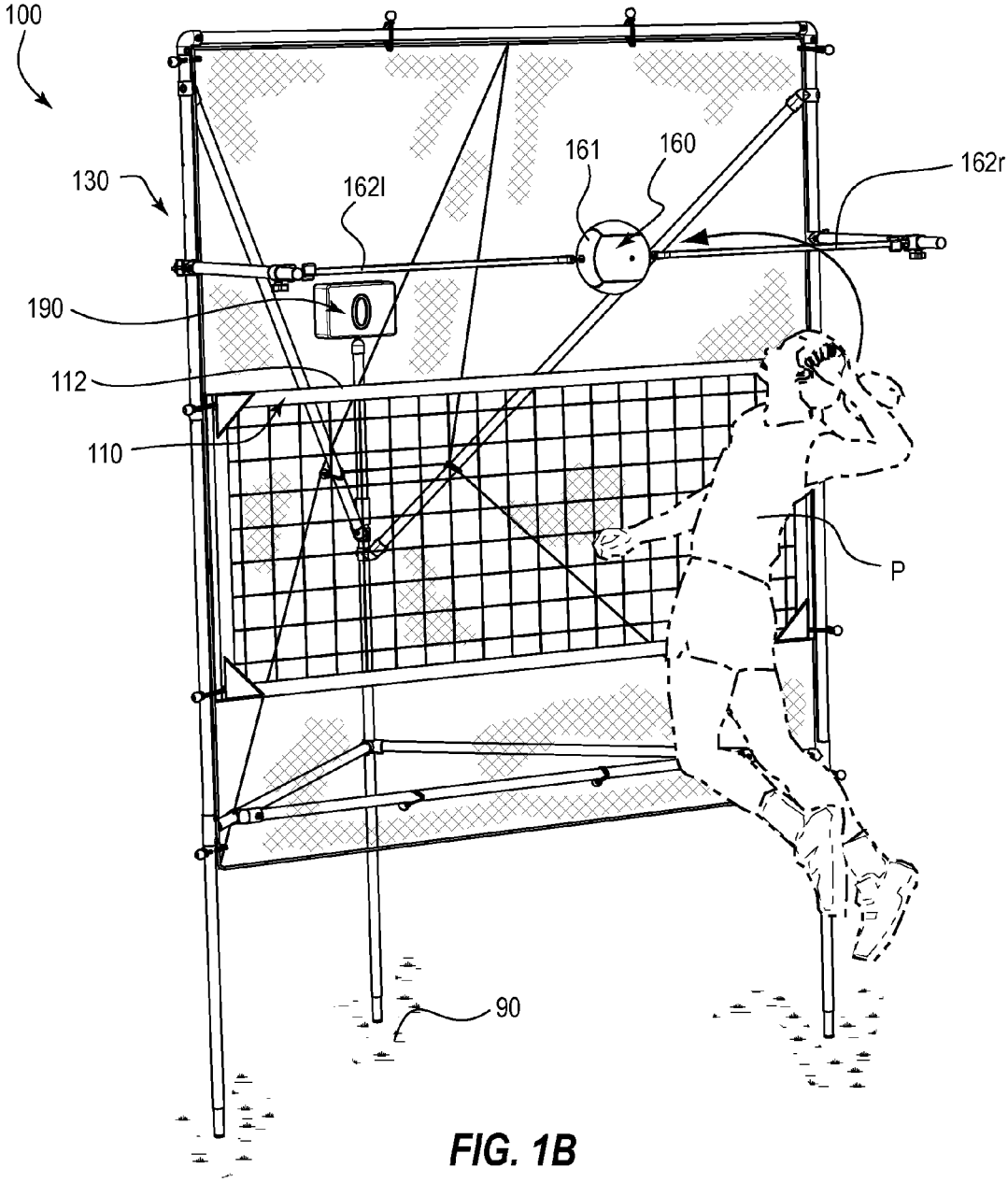
FIG. 1B is a perspective view of the volleyball hitting practice system in use by a player immediately before the player strikes a suspended ball.

FIG. 1B is a perspective view of a volleyball practice system 100 in use by a player P practicing striking ball 161 of suspended ball assembly 160. The ball 161 is positioned above top edge 112 of practice net 110 by a tether 162*l* and 162*r* or a plurality of tethers 162*l*&*r*. Left tether 162*l* and right tether 162*r* are an example of a plurality of tethers and are attached to the sides of ball 161 and suspend the ball at a user selectable position. This allows the player P to increase or decrease the height of the ball 161 being struck. The speed sensor and indicator 190 is positioned opposite of practice net 110 from the player striking the ball and can measure ball hitting performance and provides feedback to the player.

Figure 1C:
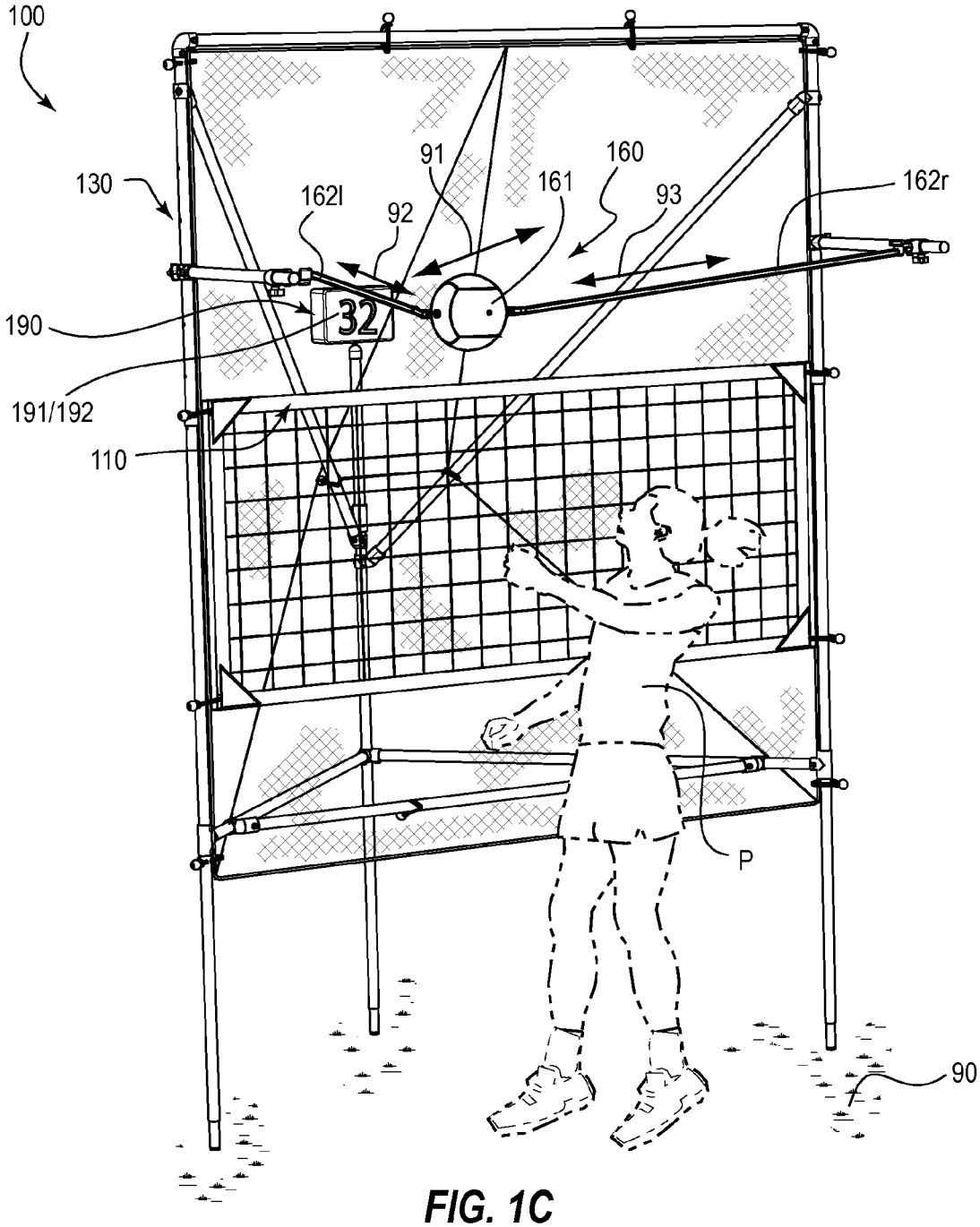
FIG. 1C is a perspective view of the volleyball hitting practice system in use by a player immediately after the player strikes a suspended ball.

FIG. 1C is a perspective view of a volleyball practice hitting system 100 immediately after a practicing player P strikes ball 161 that is part of suspended ball assembly 160.

Left tether 162*l* and right tether 162*r* are attached to frame 130 and also to ball 161 and allow the hand of the player can swing through the original suspended position of the ball after it is struck as would be done when playing a game of volleyball. The ball 161 generally travels along path 91 towards speed sensor and indicator 190. Then the plurality of tethers 162*l*&*r* decelerate the ball to a stop prior to reaching the position of the speed sensor and indicator 190 and return the ball substantially to the original suspended position. The tethers may have an elastic construction to elongate, as depicted by path 92 and path 93. The amount of force created by cords 162*l* and 162*r* that resist the ball 161 from traveling along path 91 may be minimal to cause a real like volleyball strike momentum exchange between the hand of player P and the ball. In some embodiments, this force is less than 5 pounds prior to the player striking the ball. In some embodiments, this force is less than 1 pound. In another embodiment, the initial at rest force is nearly zero is only enough to position the ball in the air and overcome gravity. As the ball 161 travels forward any slack in the tethers 162*l*&*r* is taken up and then the resistance to travel force begins to increase due to the resultant force vector on the ball from the tethers. The ball 161 may controllably decelerates to a stop and return significantly to the original suspended ball position. An electronic speed sensor and indicator 190 detects the near maximum speed of the ball 161 as travels along path 91 by speed sensor 191 and displays the speed to the player P on visual display 192. The speed sensor and indicator 190 is positioned on the opposite side of the practice net 110 from the player P. This allows immediate visual performance feedback to the player P to optimize their technique and achieve desired hitting velocities.

Figure 2:
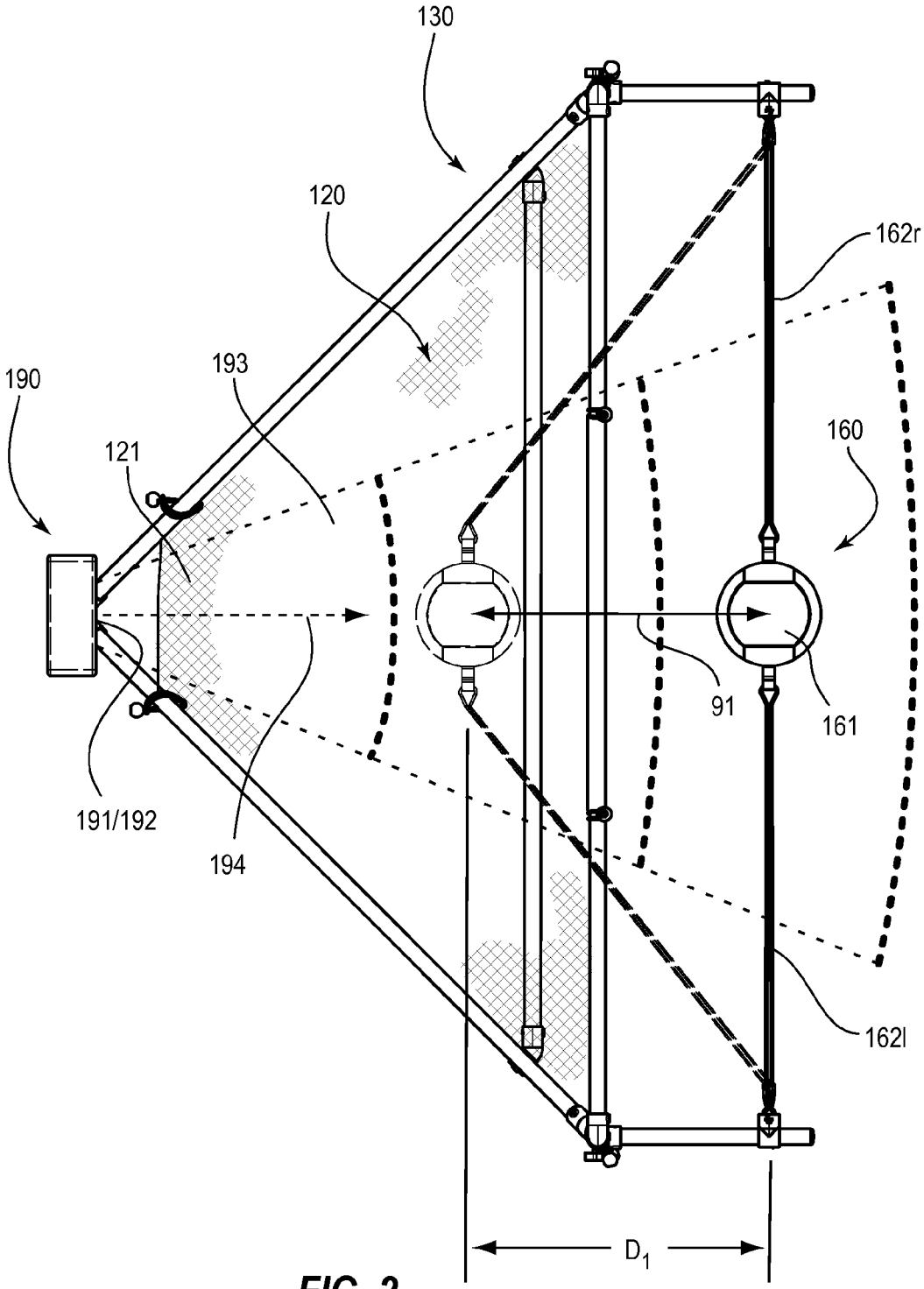
FIG. 2 is a top view of the volleyball hitting practice system showing the travel of the suspended ball through the field of view of a ball speed sensor and indicator.

FIG. 2 is a top view of volleyball practice hitting assembly 100 illustrating the travel of ball 161 of suspended ball assembly 160 through the field of view 193 of speed sensor and indicator 190. The speed sensor and indicator 190 can be an electronic radar gun that is commercially available which calculates speed of an object traveling in the field of view 193 of the speed sensor 191 using Doppler frequency shift technology. One such example of a commercially available electronic ball speed sensor and indicator used for sports that has been found useful is the SpeedTrac X™ sports radar gun manufactured by EMG Companies, Inc. (Prescott, Wis.). Another suitable electronic speed sensor and indicator unit is described by Cadotte in U.S. Pat. No. 6,091,355. These devices can be battery powered or connected to an external power source (not shown). These devices use Doppler frequency shift radar technology, which is known in the art, to generate a microwave source and transmit it from an antenna (not shown) that is part of speed sensor 191 into the field of view 193. When a moving ball 161 travels through the field of view 193, a reflection signal is generated. The reflected signal is received by the receiving antenna that is also part of speed sensor 191, and is mixed against the signal being broadcast resulting in a difference frequency component. The difference frequency is proportional to the relative speed between the target and the radar system along the line of sight, and the speed sensor and indicator 190 internal circuits instantly process the return signal and can then indicate the maximum speed of the ball 161 as it traveled along path 91 on visual display 192. The projected and received signals of the speed sensor 191 are able to pass, unaffected through netting 121 of catch net 120. This allows the catch net 120 to be a protective barrier between the moving ball 161 and the speed sensor and indicator 190, without affecting speed measuring performance.

The resulting sensed speed at which a ball 161 moves at an angle to the line of sight 194 in the projected signal field of view 193 will result in a speed shown on the visual display 192 that is lower than the true speed of the ball. As an example of the magnitude of error potential, a 10 degree entry angle reduces the actual speed by about 2%. As the angle increases, the display speed will decrease. The speed sensor and indicator 190 is attached to frame 130 and positioned to minimize this error. In some embodiments, the line of sight 194 of the ball speed sensor 191 is positioned within a 30 degree angle to the ball travel path 91. In another embodiment, the line of sight 194 of the ball speed sensor 191 is positioned within a 15 degree angle to the ball travel path 91. In another embodiment, the line of sight 194 of the ball speed sensor 191 is positioned within a 5 degree angle to the ball travel path 91.

To allow the speed sensor 191 enough sample time to detect the speed of ball 161 moving through field of view 193, the ball travels along path 91 that is sufficient in length $D_1$ and also over a duration of time where the ball is traveling near maximum velocity after it has been struck that the sensor can send, receive, and process the signal to generate a signal in response to the near maximum rate of travel of the ball. A travel length greater than 12 inches has been found to allow the speed sensor to calculate a ball speed and also allow the player P to freely swing their hand through the ball 161. Left tether 162*l* and right tether 162*r* attached to frame 130 and to the ball 161 cause the ball to decelerate and then return substantially to the original position of the suspended ball.

Figure 3A:
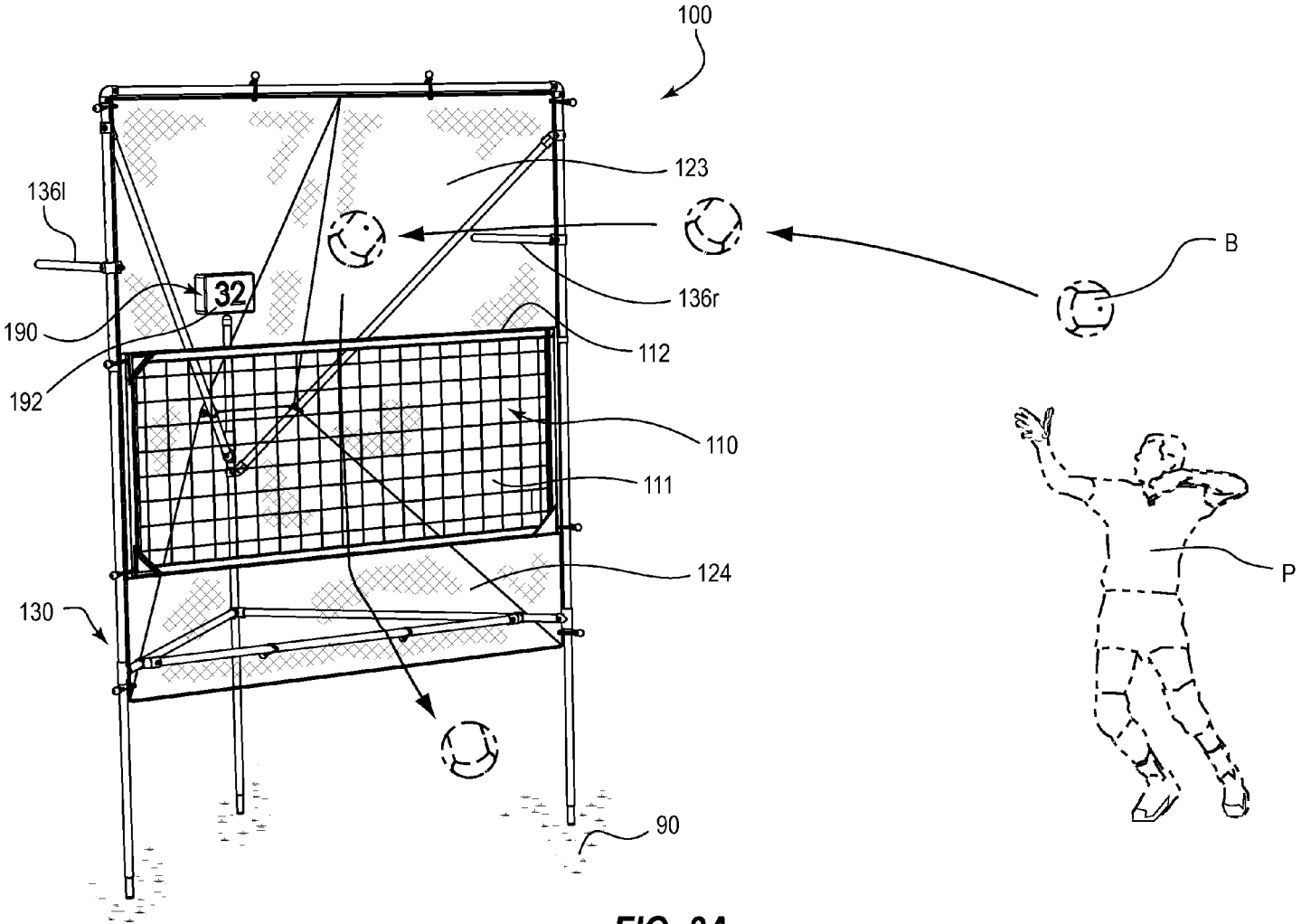
FIG. 3A is a perspective view of a volleyball hitting practice system in use by a player hitting volleyballs into the system where the balls are received by a catch net and then exit the system.

FIG. 3A is a perspective view of a volleyball hitting practice system 100 in use by a player P practicing hitting or serving the volleyball B. Suspended volleyball assembly 160, not shown in FIG. 3A but shown in FIGS. 1-2, is selectively removed from the system and extension arms 136*l* and 136*r* attached to frame 130 may be selectively positioned away from the receiving region 123 of catch net 120. The player P attempts to hit the volleyball B towards practice net 110 and above top edge 112 and into the receiving region 123 of catch net 120. When the volleyball engages catch net 120, the volleyball B may lose momentum or may be deflected downward and drops behind practice net 110. The volleyball B can then exit the volleyball hitting practice system 100 through the exiting region 124 near the vertical plane 111 of practice net 110 towards horizontal surface 90 or the volleyball may exit the system toward the general direction of the player P. In some embodiments, the volleyball B exits the system 100 at a distance of 5 feet behind planar surface 111 of practice net 110 opposite from the player P to within 1 foot in-front of the practice net. In one embodiment, the volleyballs B exit the system within 1 foot of planar surface 111 of practice net 110. Redirecting the flight path of volleyball B saves the player P time from having to retrieve the volleyball B. Similar to the above discussion for FIG. 2, the speed sensor and indicator 190 detects near maximum speed of the volleyball B as it travels into the receiving region 123 of catch net 120 and indicates volleyball speed to the player P on visual display 192. The ball speed sensor and indicator 192 is positioned opposite of the practice net 110 from the player P and behind catch net 120. This allows immediate visual feedback to the player P to optimize their technique and achieve desired hitting velocities and protects the speed sensor and indicator 190 from getting damaged by volleyballs that would otherwise impact the speed sensor and indicator.

Figure 3B:
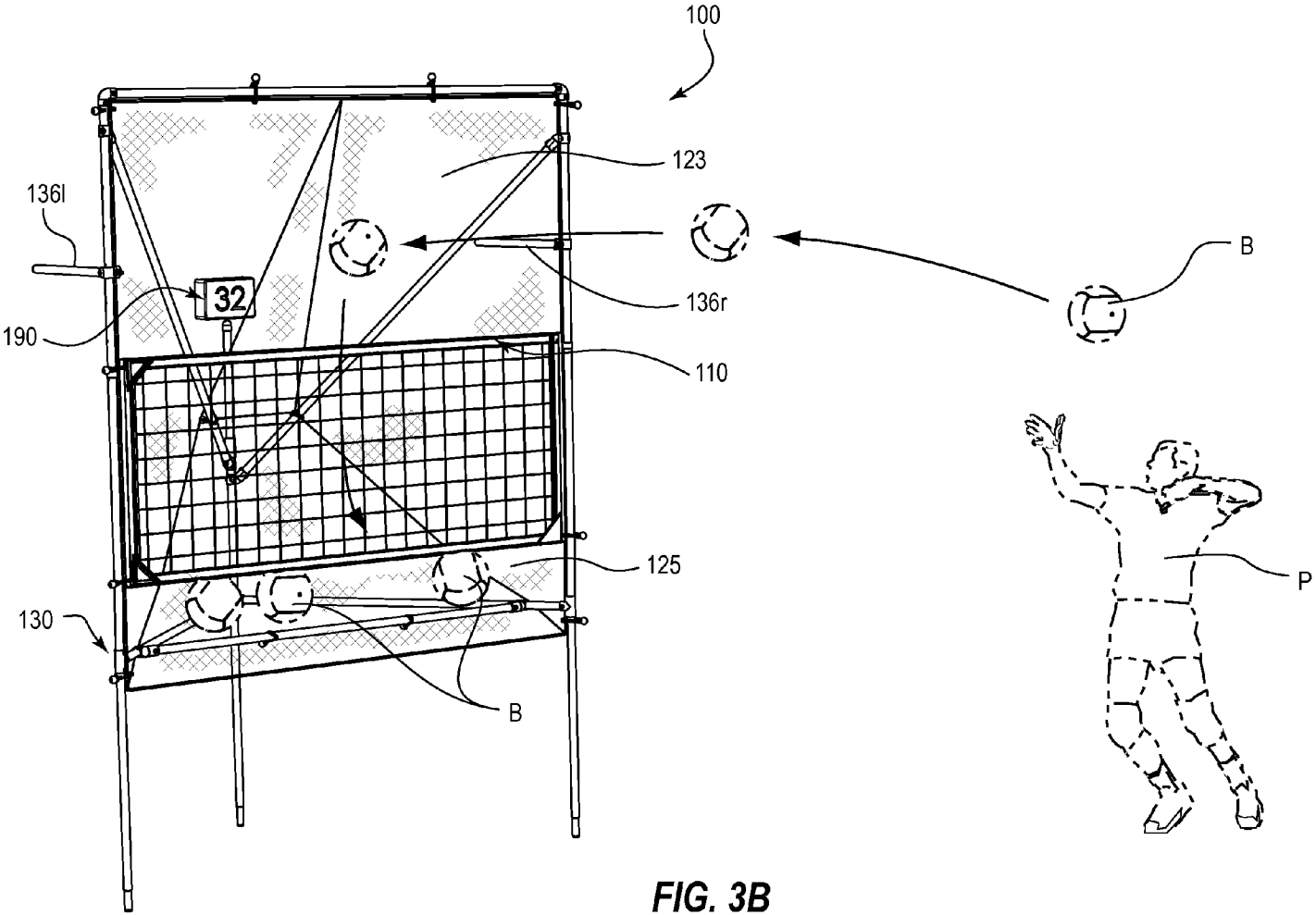
FIG. 3B is a perspective view of a volleyball hitting practice system in use by a person hitting balls into the system where the balls are caught and then collected in the system.

FIG. 3B is a perspective view of a volleyball practice system 100 in use by a player P practicing hitting or serving the volleyball B. The ball can travel over the practice net 110 and into the receiving region 123 of catch net 120. The volleyball B can lose momentum or can be deflected downward when it engages catch net 120. The volleyball B can be captured and collected in capture region 125 for player P or another person to subsequently selectively remove the volleyball B. Multiple volleyballs can be captured and then selectively removed by deflecting the flexible practice net 110 up or the flexible catch net 120 down to release the volleyball or volleyballs. Other alternate catch net 120 and practice net 110 configurations are anticipated that would cause the volleyballs B to be retained in the system for subsequent selective removal.

Figure 4:
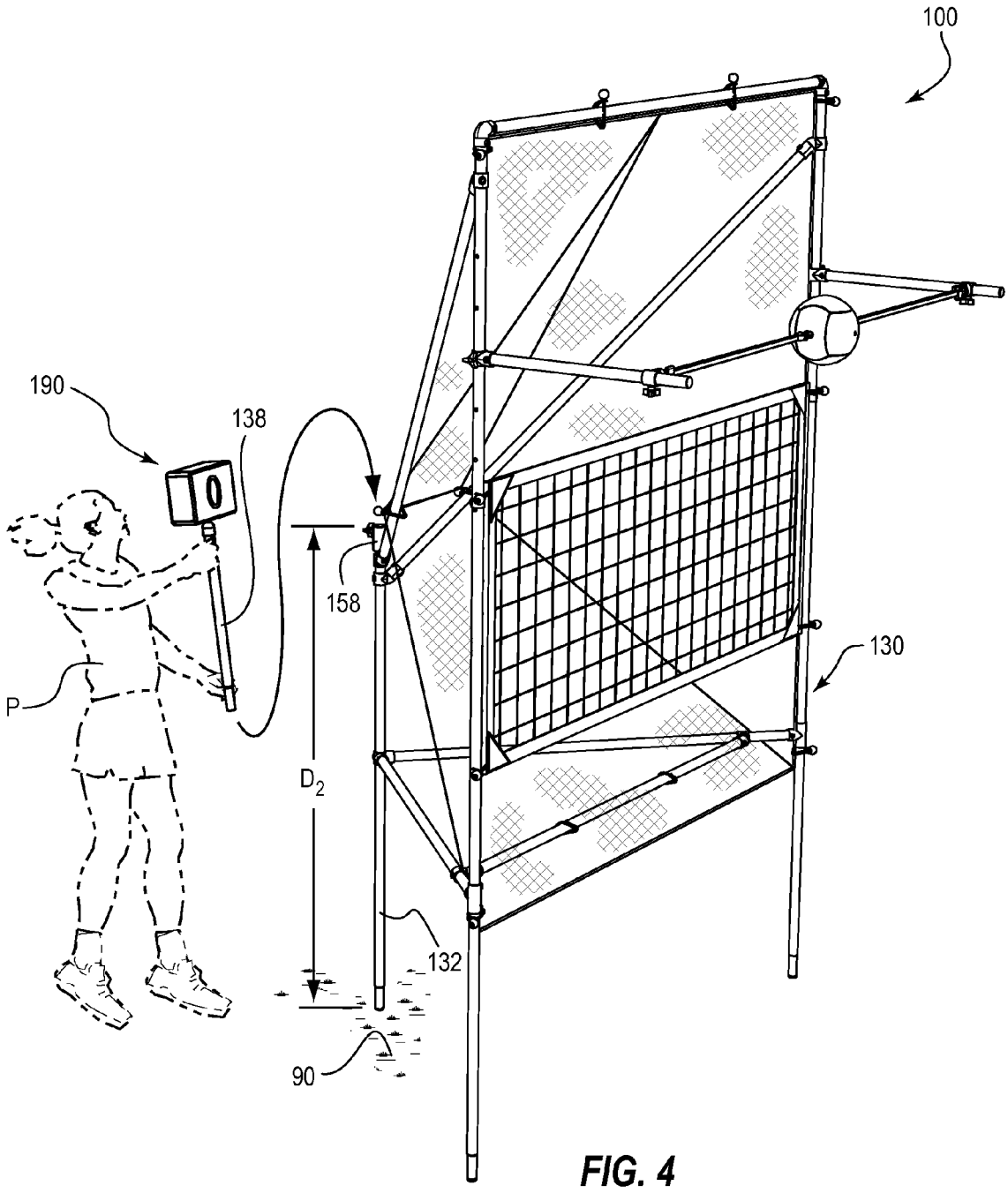
FIG. 4 is a perspective view of a volleyball hitting practice system where the speed sensor is being attached to the frame by a player.

FIG. 4 is a perspective view of a volleyball practice system 100 depicting a player P selectively attaching and positioning a speed sensor indicator to the support frame 130. Since the speed sensor and indicator 190 needs to be positioned to read the speed of ball 161 or the speed of volleyball B where the ball is traveling toward the sensor, a selectively removable and positionable extension member 138 is attached to the bottom of the speed sensor and indicator 190. FIG. 4 along with FIG. 8 (a section view identified in FIG. 5 and a partial section view of the extension member attachment) shows how extension member 138 engages coupler fitting 158 that is attached to rear pole 132. The player P is able to release the sensor pole from the frame 130 at a comfortable height $D_2$. In some embodiments this height can be less than 7 feet vertical elevation from the horizontal surface 90 or ground. This allows the player P to remove the speed sensor and indicator from the system 100 to turn on and off or adjust the controls of the speed sensor and indicator 190 and then place it back onto the system. Also, this removal allows for securing the higher cost and possibly weather sensitive electronics from the system when not in use for secure storage or when using the system without the speed sensor and indicator 190.

Figure 5:
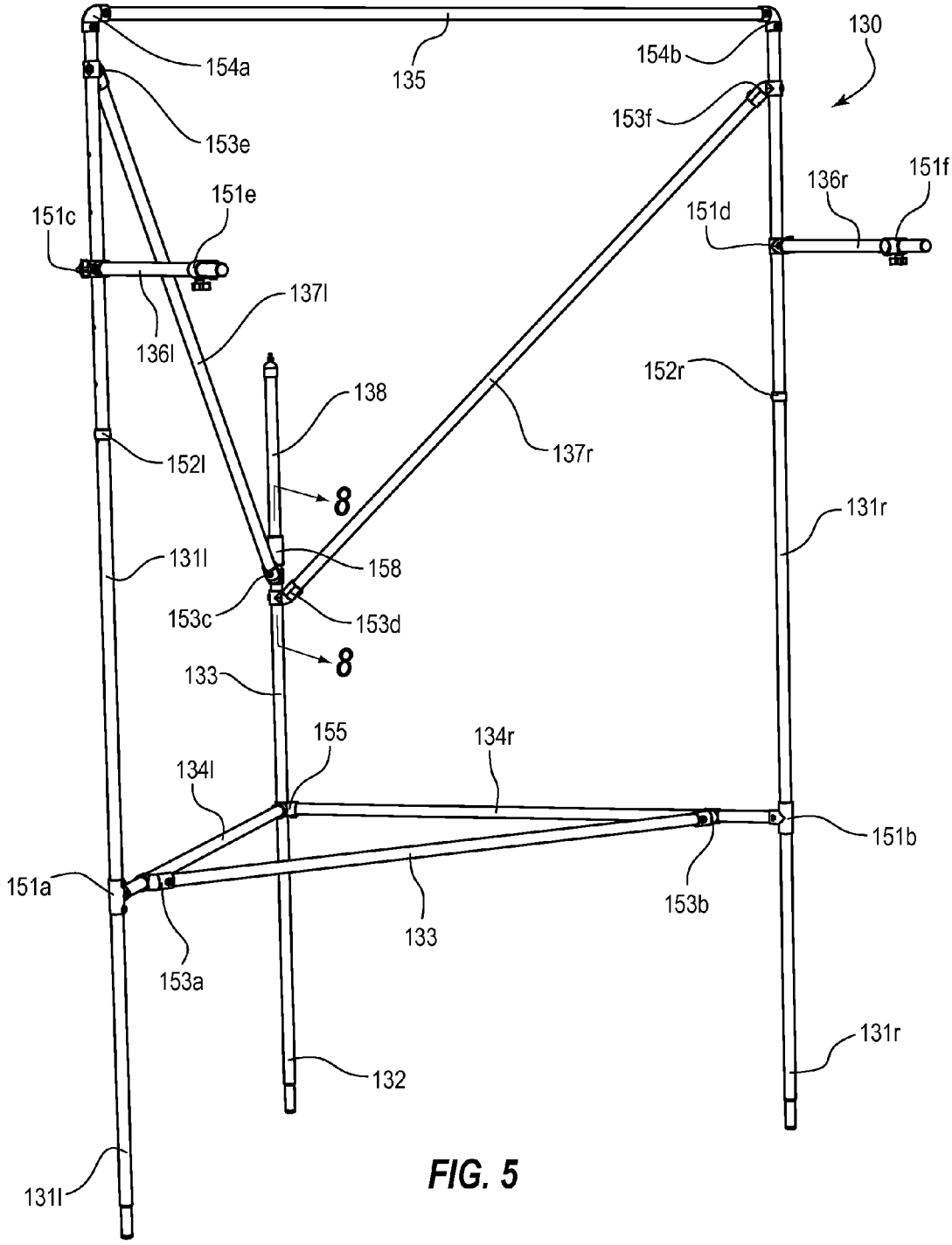
FIG. 5 is a perspective view of a frame of the volleyball hitting practice system.

FIG. 5 is a perspective view of a frame 130 showing how the frame may be constructed. The frame 130 is constructed from a plurality of support members that may include a left pole 131*l*, right pole 131*r*, rear pole 132, top pole 135, lateral poles 137*l* and 137*r*, truss poles 134*l* and 134*r*, and a cross pole 133. Left pole 131*l* right pole 131*r* and rear pole 132 are interconnected by top pole 135, lateral poles 137*l* and 137*r*, truss poles 134*l* and 134*r*, and cross pole 133 using tee fittings 151*a* and 151*b*, branch tee fittings 153*a*, 153*b*, 153*c*, 153*d*, 153*e*, and 153*f*, and elbow fittings 154*a* and 154*b*. Left extension arm 136*l* and right extension arm 136*r* are each attached using tee fittings 151*c* and 151*d* respectively. The poles can be standard metal pipes or metal tubes cut to various lengths. In some embodiment, the metal pipes are structural round steel tubes that have diameters similar to a standard 1" pipe or maybe standard size chain link fence poles that are readily commercially available. The slip-on pipe fittings are commercially available and commonly used for building simple structures from metal pipe. One source for obtaining slip-on metal pipe fittings is Kee Safety, Inc. located in Buffalo, N.Y. Alternate methods of frame construction are anticipated such as welding, bending, gluing, and other types of fastening devices.

Figure 6:
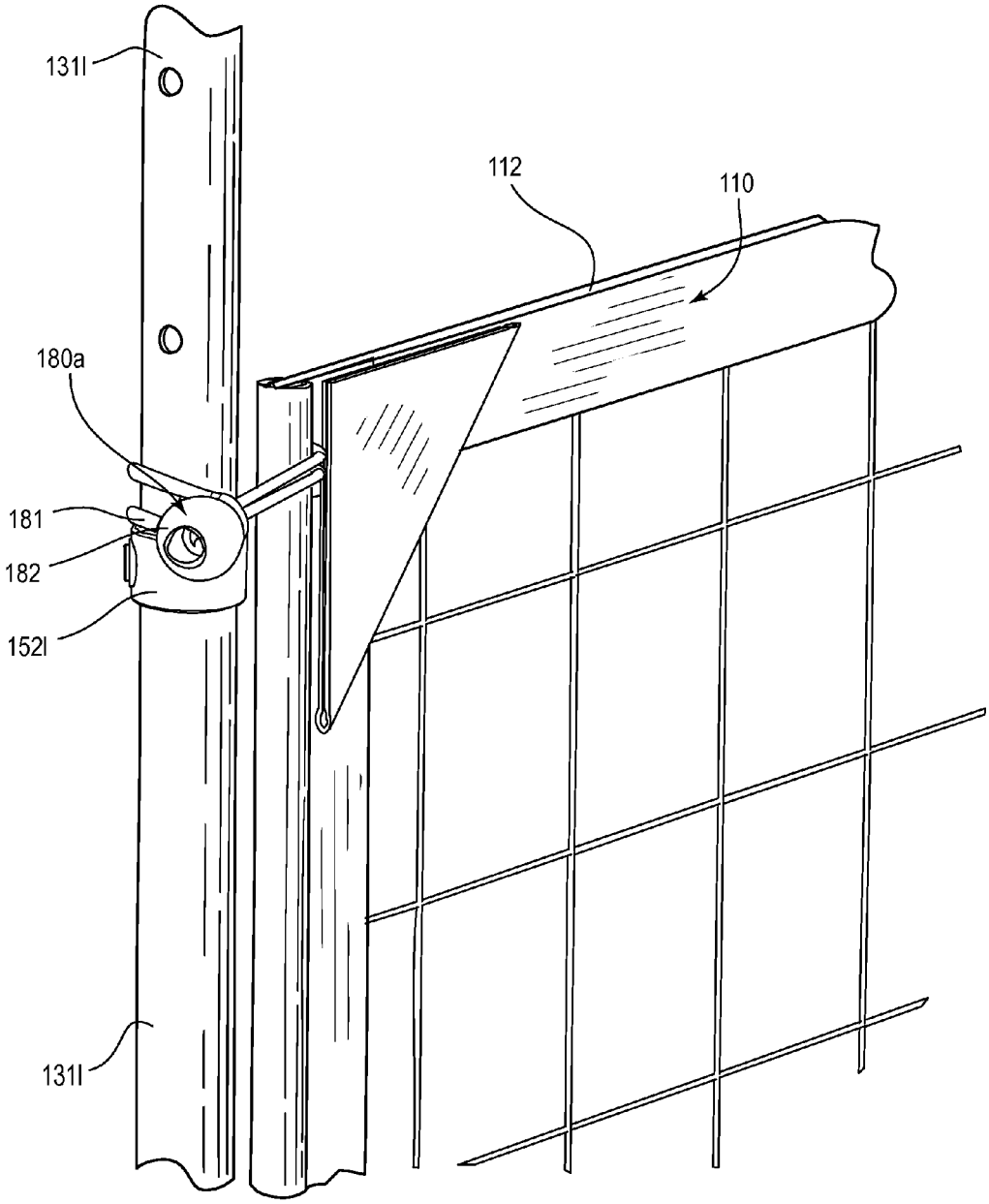
FIG. 6 is a cutaway perspective view of a practice net attached to the frame of the volleyball hitting practice system.

FIG. 6 is a partial perspective view of the upper left side and corner of practice net 110 attached to frame 130 using loop cord 180. Collar 152*l* can be selectively positioned vertically along left post 131 to establish the vertical height top edge 112 of practice net 110. Elastic cord 181 stretches around pole 131 through an opening in net 110 and loops back over cord ball 182 and rests on top of collar 152*l*. The net height can be selectively repositioning to a desired height by moving collar 152*l*. This can be done by loosening a setscrew (not shown) that fastens collar 152*l* to pole 131*l*, selectively repositioning the collar, and then retightening the screw. Similarly, the right side height of practice net 110 can be adjusted by moving collar 152*r* vertically along right post 131*r*.

Figure 7:
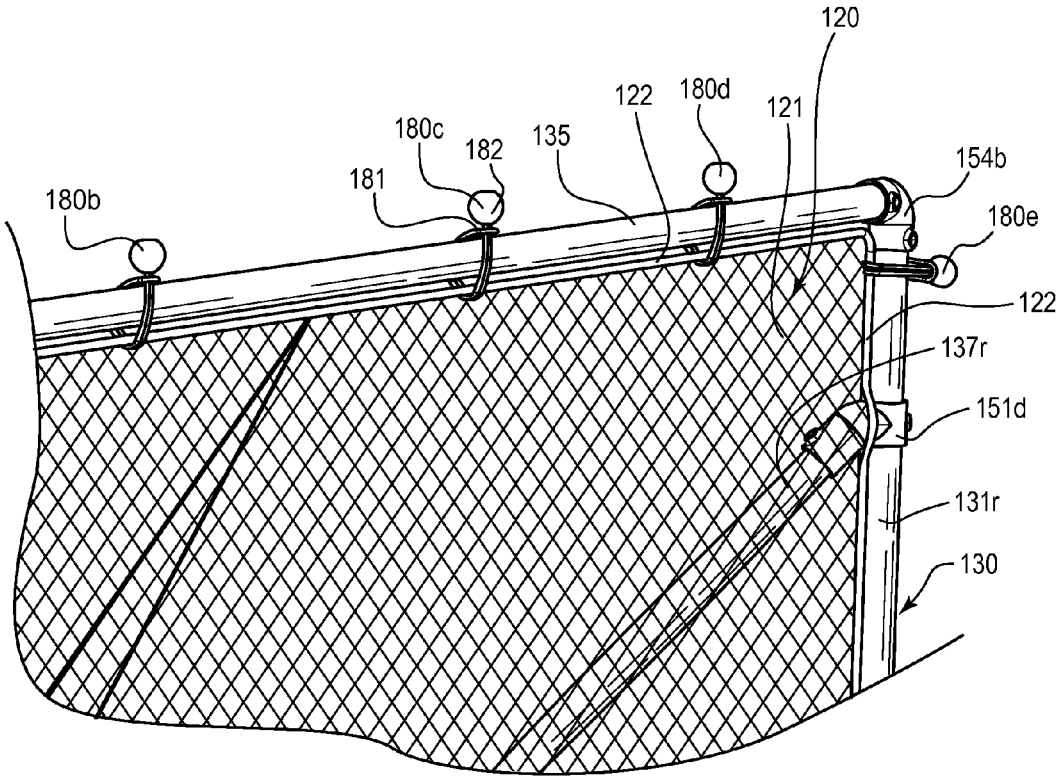
FIG. 7 is a cutaway perspective view of a catch net attached to the frame of the volleyball hitting practice system.

FIG. 7 shows an embodiment of an attachment of the catch net 120 to the frame 130, which are both components of the volleyball hitting practice system. Elastic cord 181 of loop cord 180*c* stretches around top pole 135 and through an opening in catch net 120 or through the netting 121 and loops back over cord ball 182. Multiple loop cords 180*b*, 180*c*, 180*d*, and 180*e* may be employed in multiple locations to attach catch net 120 to frame 130 so the catch net 120 may take a similar shape to the frame 130. In some embodiments, the catch net 120 is attached to at least 2 of the plurality of support members of frame 130. In some embodiments, the catch net is attached to at least 3 of the plurality of support members of frame 130 creating a concave receiving region in the portion of catch net the extends above the top edge 112 of practice net 110.

Figure 8:
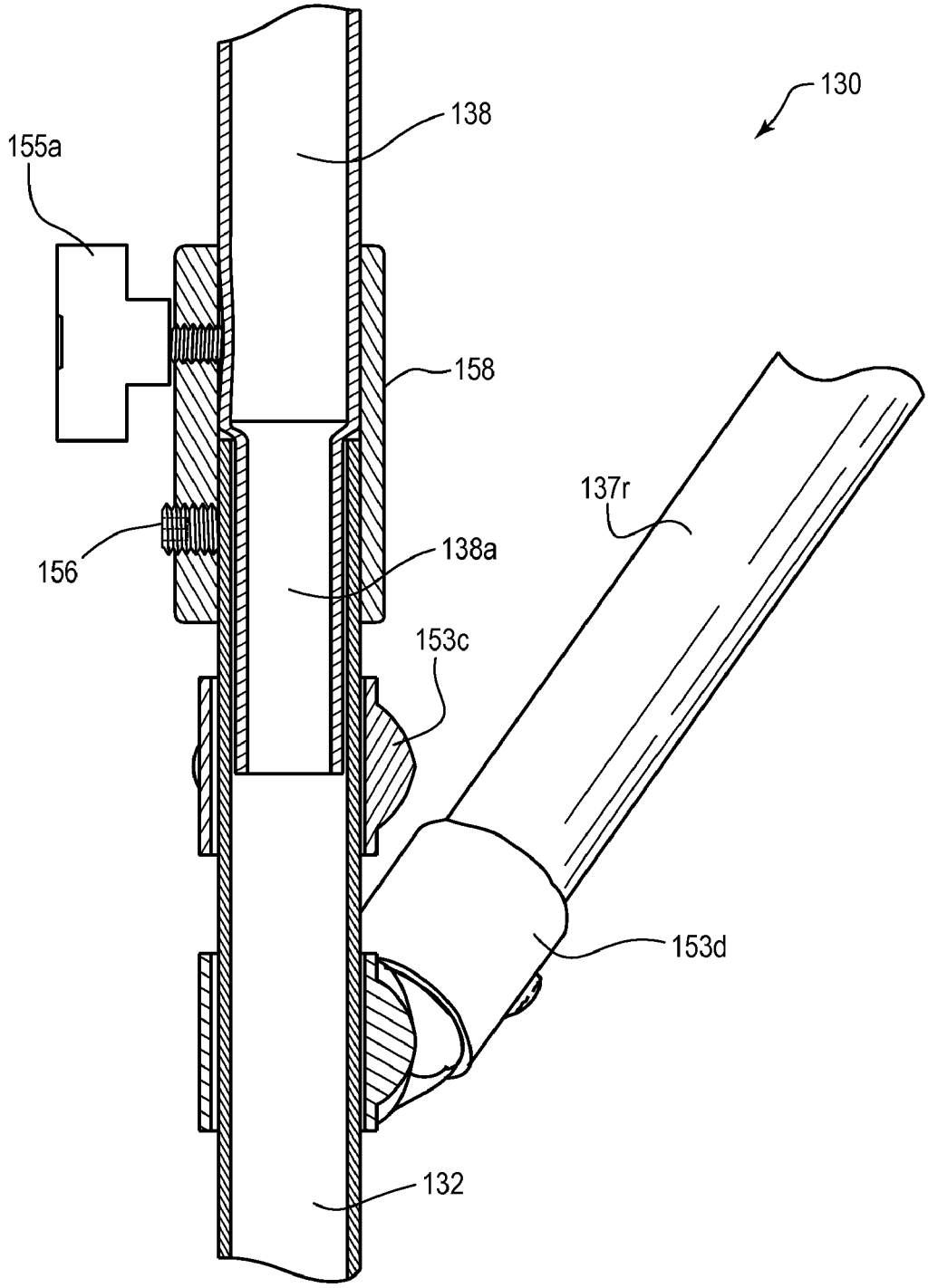
FIG. 8 is a cutaway section view of an extension member used to attach a speed sensor to the frame.

FIG. 8 is a partial section view of volleyball hitting practice system 100 as identified in FIG. 5. The extension member attachment, shows how extension member 138 engages coupler fitting 158 that is secured to rear pole 132 of frame 130 using screw 156. A knob screw 155*a* can be hand tightened without using tools to secure pole 138 to the other end of coupler 158 after pole end 138*a* is inserted into pole 132. The configuration allows for height and rotation adjustment of the speed sensor and indicator 190. Branch tee fittings 153*c* and 153*d* and lateral pole 137*r* are also identified in the figure for reference.

Figure 9:
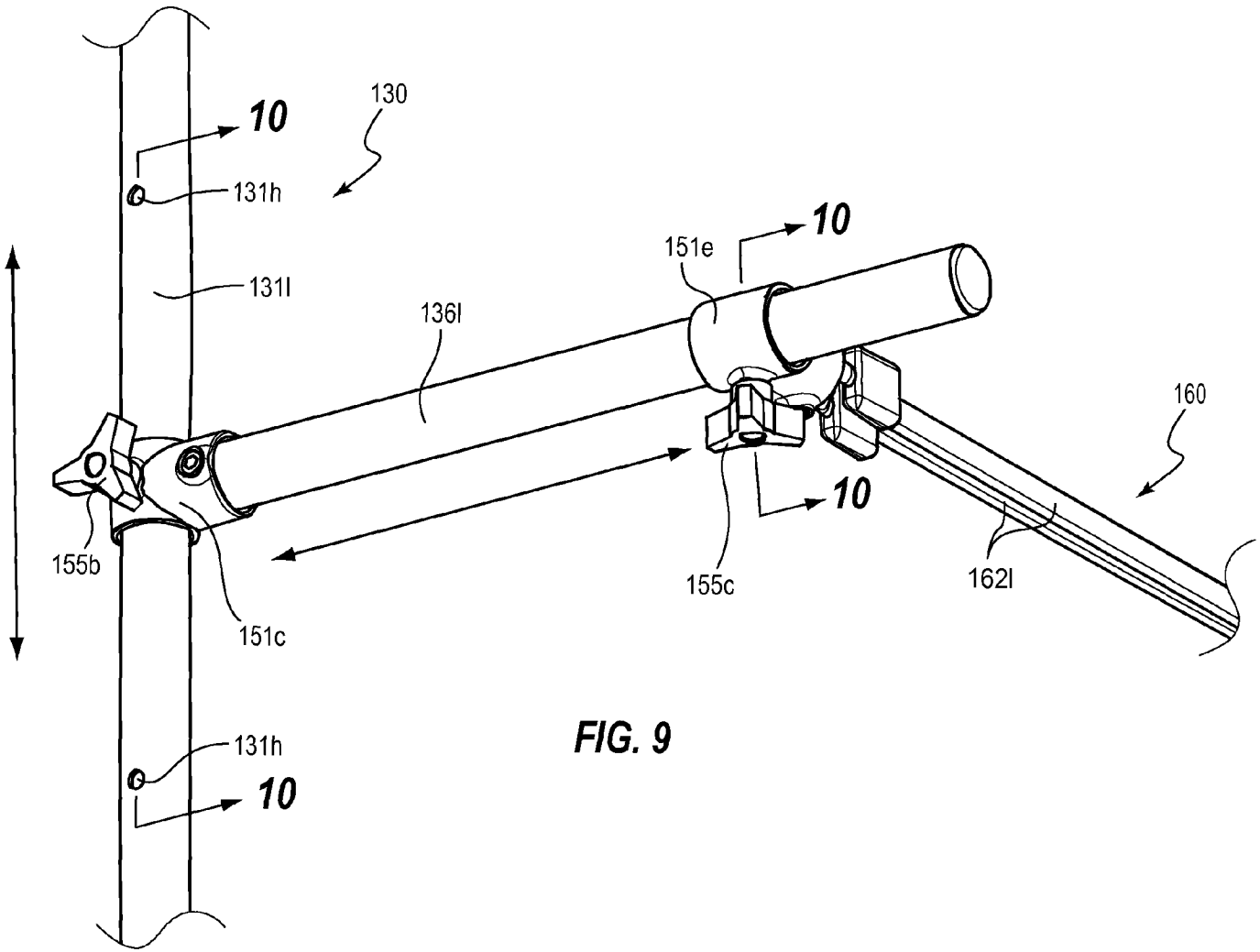
FIG. 9 is a cutaway perspective view of an adjustable positioning system used to selectively position the suspended ball from the frame of the volleyball hitting practice system.
Figure 10:
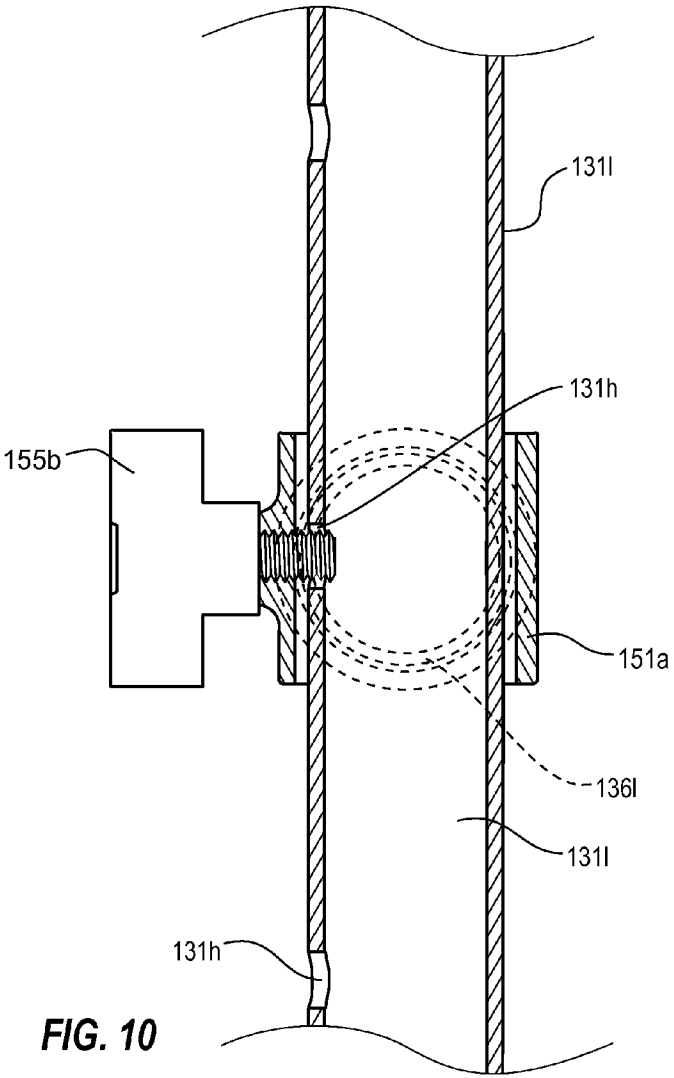
FIG. 10 is a cutaway section view of the selectively adjustable positioning system where a threaded fastener engages a hole in the frame.

FIG. 9 is a partial perspective view of frame 130 and suspended ball assembly 160, which are both components of volleyball hitting practice system 100. Tee fitting 151*c* can be selectively positioned vertically along left pole 131*l* to change the vertical height of ball 161 (shown in FIGS. 1-2) of suspended ball assembly 160 by loosening, selectively repositioning, and tightening knob screw 155*b*. High twisting or moment forces may be created on fitting 151*c* as the ball 161 is struck by a player P and may cause the extension arm 136*l* to move to an undesired position. In some embodiments and as best depicted in FIG. 10, which is a section view taken from FIG. 9, holes 131*h* in left pole 131*l* allow the knob screw 155*b* to advance forward into the hole by threading into fitting 151*a* and prevent extension arm 136*l* from twisting out of position by mechanical interference between the hole 131*h* and the tip of the knob screw. Tee fitting 151*e* can be positioned along extension arm 136*l* at a transverse distance away from the planar surface 111 of the practice net 110 to establish a horizontal position of the attachment between the frame 130 and suspended ball assembly 160.

Figure 11:
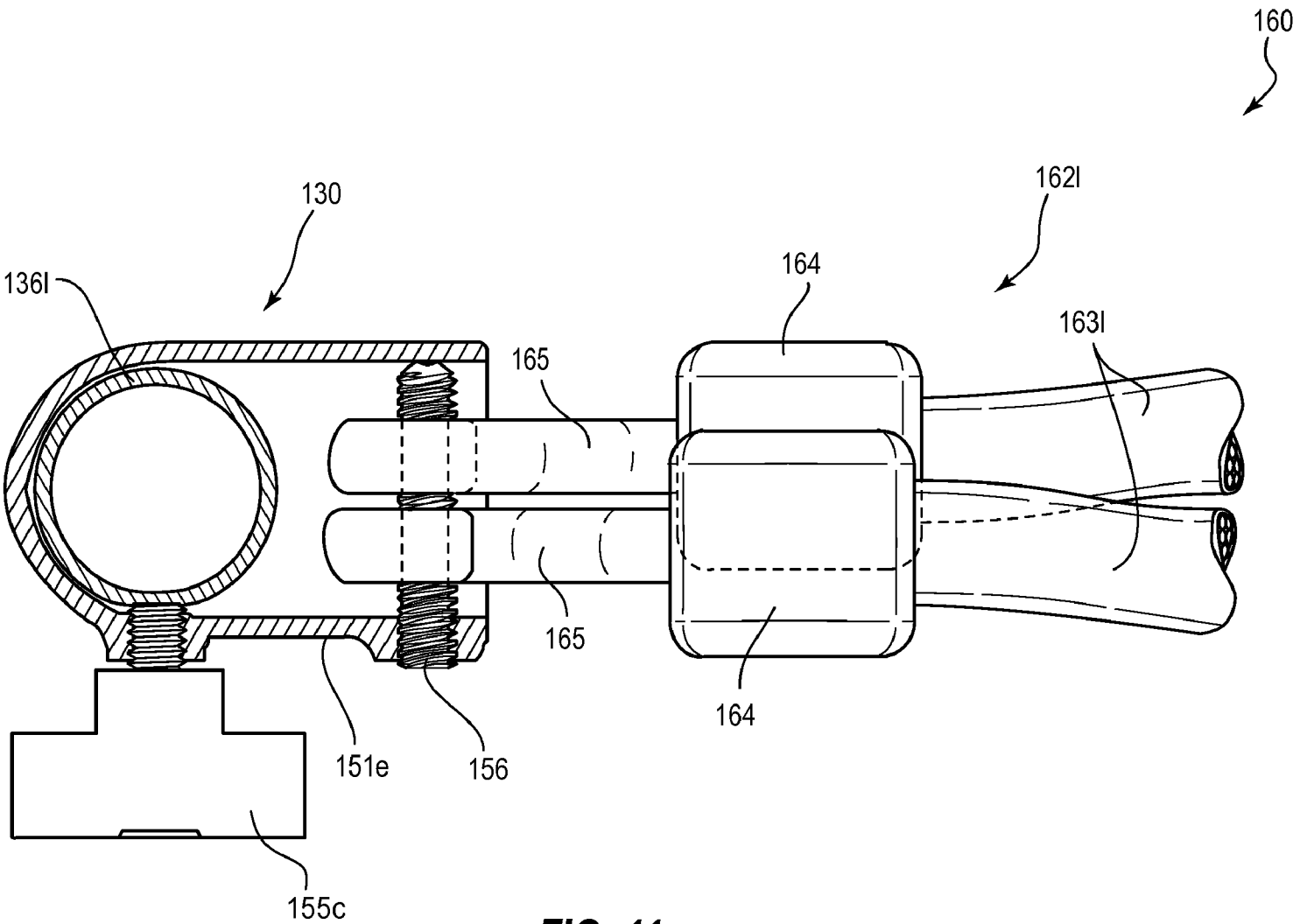
FIG. 11 is a partial cutaway section view of the volleyball hitting practice system where a tether attached to the suspended ball assembly attaches to the frame.

FIG. 11 is a partial section view taken from FIG. 9 showing a method of attachment of the left tether 162*l* of suspended volleyball assembly 160 to frame 130, which are components of volleyball hitting practice system 100. Left tether 162*l* may be constructed of elastic cord 163*l* with end attachments 164 that transition into hooks 165. A screw 156 threaded into tee fitting 151*e* may extend and be positioned across the opening in the fitting, this opening may have otherwise been used to attach a structural member, and through hooks 165, thus securing the end of left tether 162*l* to frame 130. Knob screw 155*c* may be hand loosened allowing tee fitting 151*e* to slide substantially horizontally closer or further away from planar surface 111 of practice net 110 and around extension arm 136*l*. The tee fitting 151*e* can be selectively positioned and then knob screw 155*c* tightened to secure the tee fitting 151*e* to extension arm 136*l* of frame 130.

Figure 12:
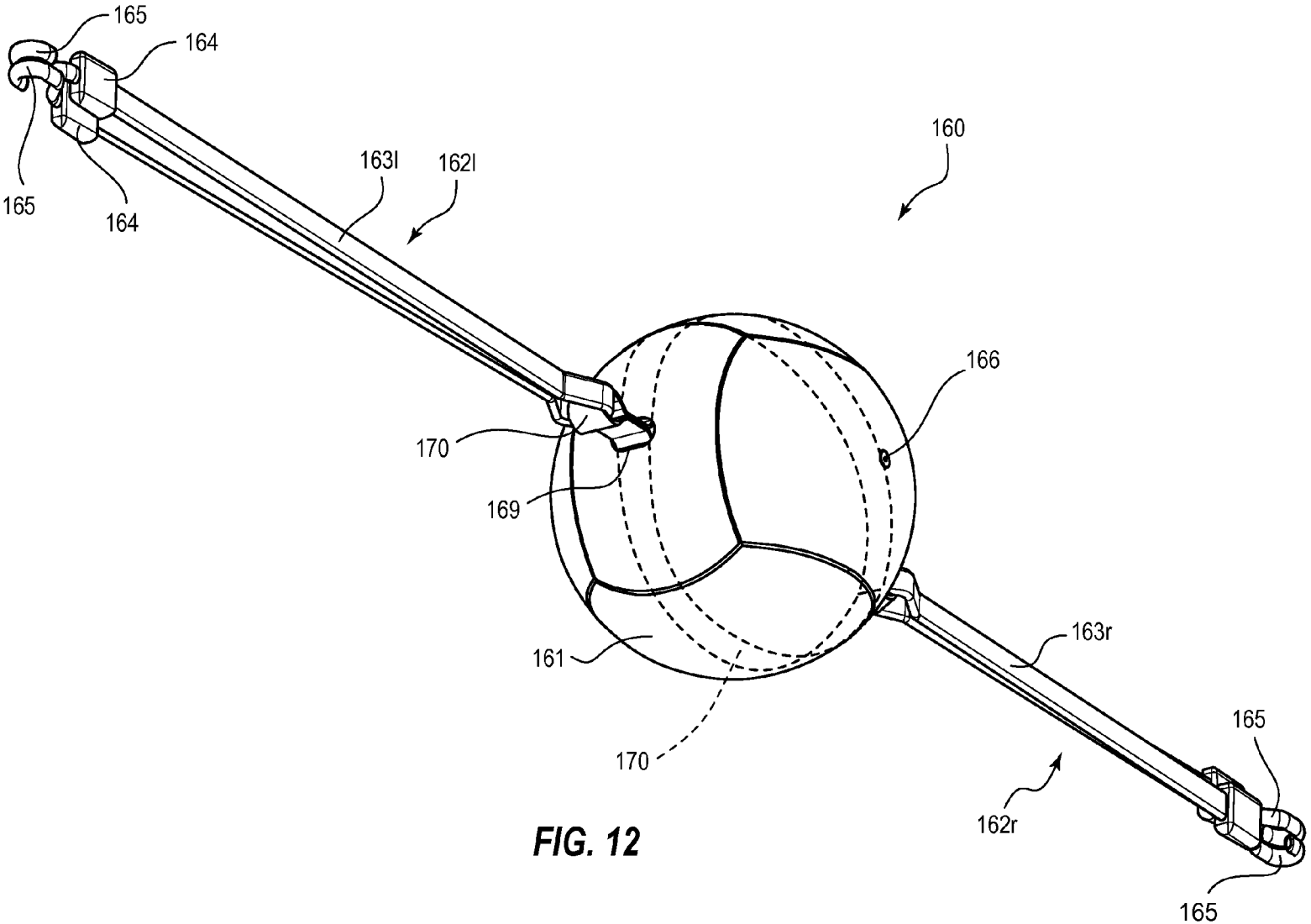
FIG. 12 is a perspective view of the suspended ball assembly showing tethers attached to the sides of a ball.

FIG. 12 is a perspective view of the suspended volleyball assembly 160, which is a component of volleyball hitting practice system 100. Left tether 162*l* and right tether 162*r* are connected to ball 161 by interconnecting with strap 170. As discussed above, the tethers may be constructed with an elastic cord 163*l* and 163*r* with end attachments 164 configured with hooks 165 that can be attached to a feature on frame 130. Strap 170 is positioned under the outside covering of ball 161 and extend through openings 169 in ball 161. An air valve 166 allows air pressure to be adjusted inside the ball 161 that changes the firmness of the ball.

Figure 13:
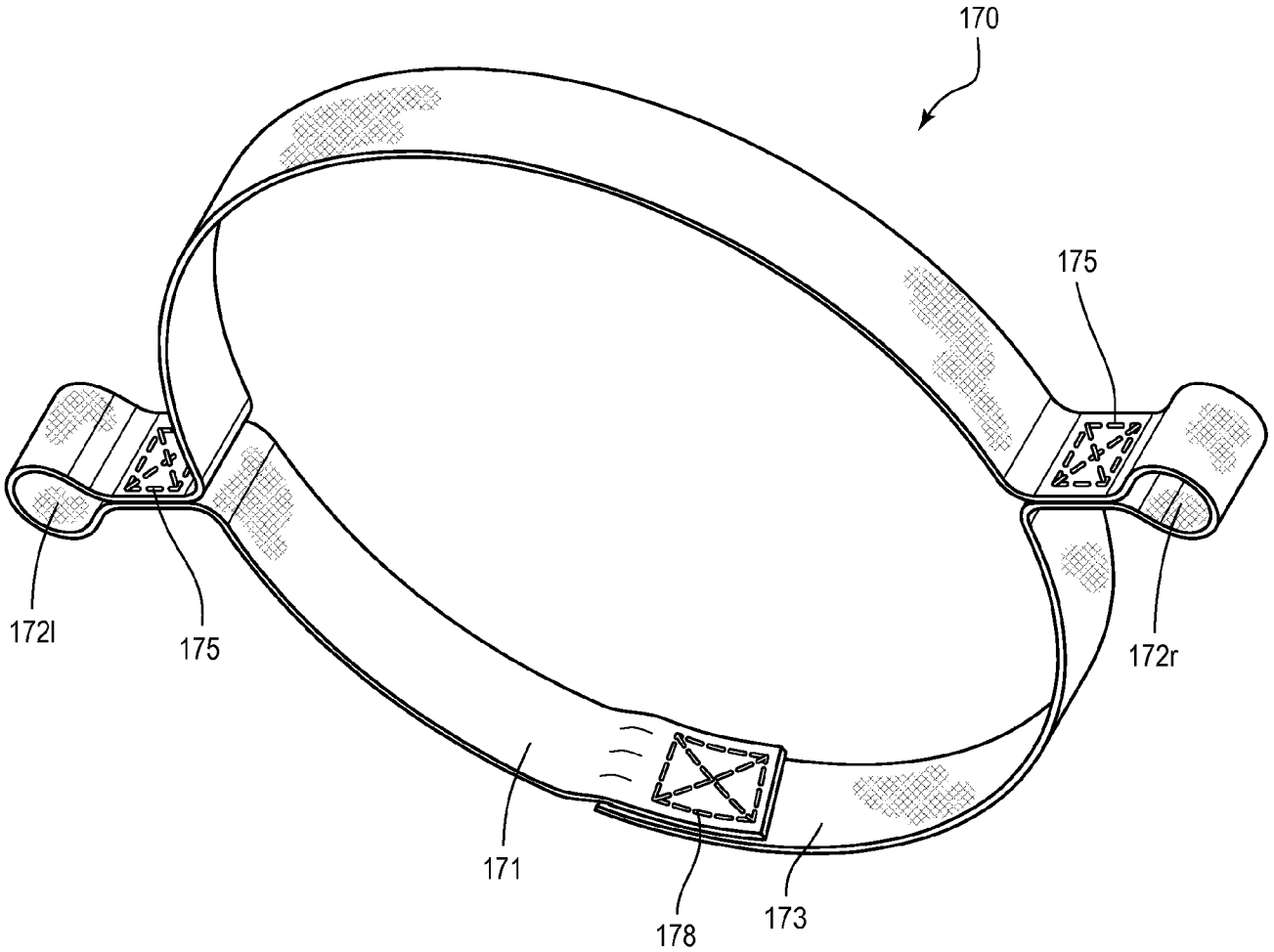
FIG. 13 is a perspective view of a strap used to attach the suspended ball to the tethers as shown in FIG. 12.

FIG. 13 is a perspective view of strap 170 that can be used to attach ball 161 to left tether 162*l* and right tether 162*r*. The strap is constructed of commonly available strapping material 171 stitched together to form a large loop approximately the diameter of the inside spherical diameter of ball 161. The ends of strap 170 are connected by overlapping the strap material and stitches 178 placed through the material using a suitable thread. Strap loops 172*l* and 172*r* are created by additional sets of stitches 175. The strap material may be of nylon, polypropylene, or other weather resistant material with a fabric construction.

Figure 14:
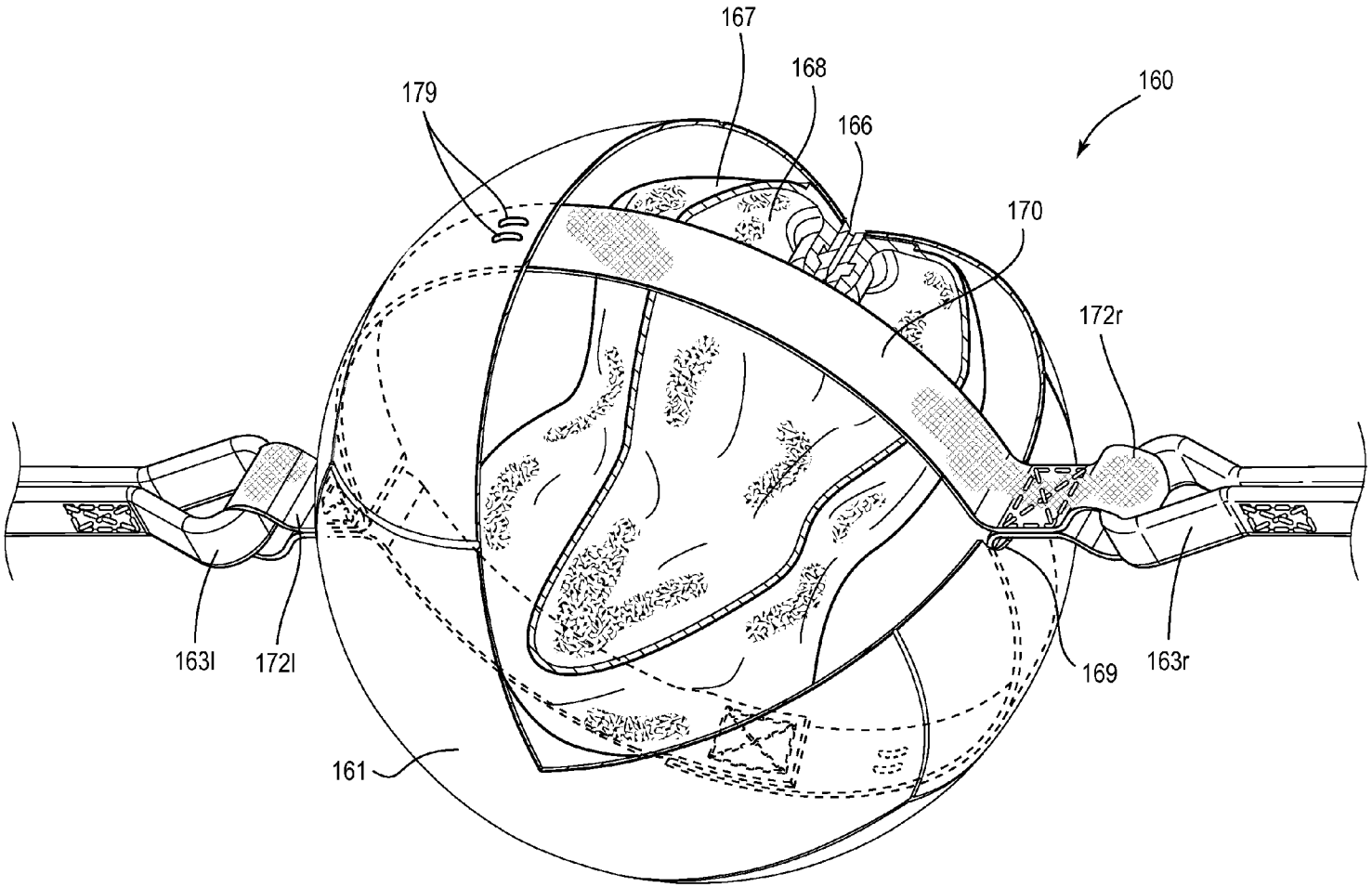
FIG. 14 is a cutaway perspective view of the suspended ball assembly with the bladder of the ball partially deflated.

FIG. 14 is a cutaway perspective view of suspended ball assembly 160 with the internal bladder 167 partially deflated. Several types of volleyballs are commonly used and commercially available and some types of volleyballs have a non-integral bladder 168 that can be deflated that creates a space between the covering of ball 161 and the bladder 167. Openings 169 can be cut into the covering of ball 161 and the strap 170 placed inside. Tack stitches 179 can assist in keeping the strap in place while the reservoir 168 of bladder 167 is filled with air through valve 166. The air pressure in the bladder 167 positions the strap on the inside surface of the covering of ball 161. When ball 161 is struck by a player, forces are transferred to strap 170 and then to cords 162*l* and 163*r* through strap loops 172*l* and 172*r*.

Figure 15:
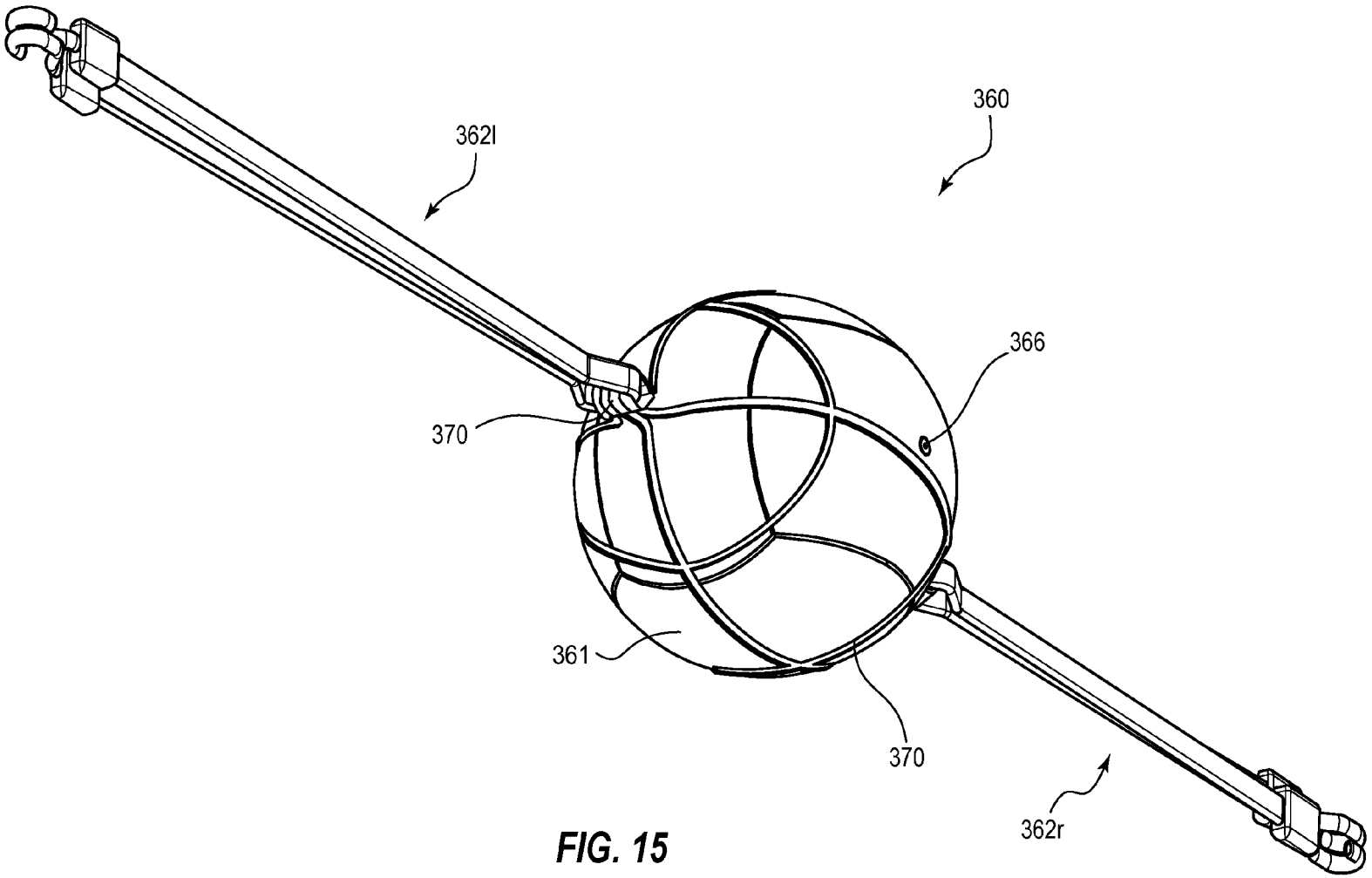
FIG. 15 is a perspective view of the suspended ball assembly showing tethers attached to a sling that holds a volleyball.

FIG. 15 is a perspective view of another embodiment of the suspended volleyball assembly 360. Left tether 362*l* and right tether 362*r* are connected to ball 361 by interconnecting with sling 370. The sling 370 may be a mesh, net, fabric, or interconnected cords that can hold the ball 361 in place and transfer loads to tethers 362*l*&*r* when the ball is struck by a player. The ball 361 may be positioned in the sling by deflating air from the ball through valve 366, compacting the ball, positioning the ball through an opening in the sling 370, and then inflating the ball. The sling 370 may also be constructed to stretch open to allow the placement of the ball inside the sling or the sling may have a portion that is removed for placement of the ball and then securely attached. The tethers may be constructed with an elastic cord 363*l* and 363*r*. The air valve 366 is used to adjust air pressure ed inside the ball 161 that changes the firmness of the ball.

Figure 16:
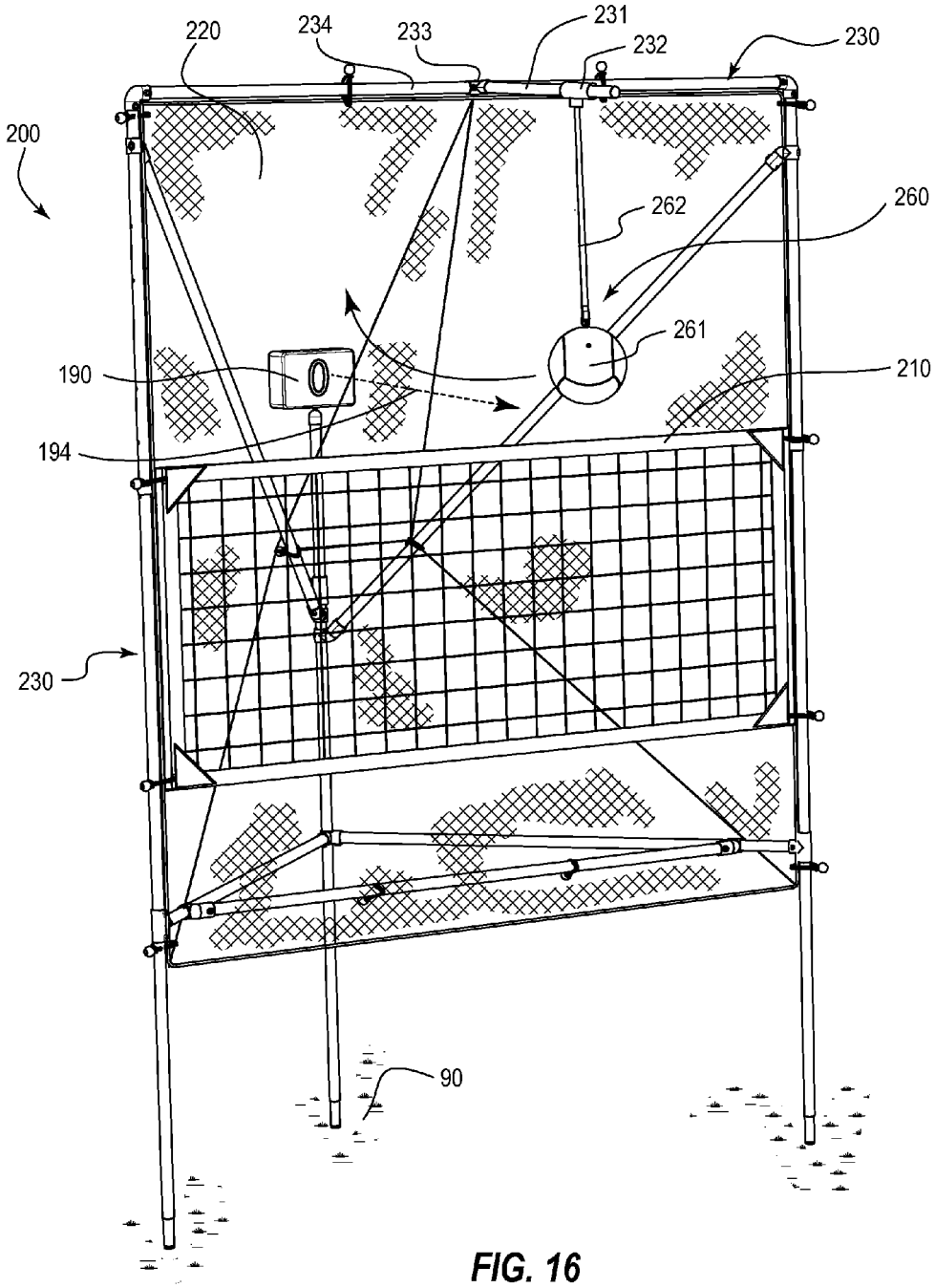
FIG. 16 is a perspective view of a volleyball hitting practice system showing a ball suspended by a single tether.

FIG. 16 is a perspective view of another embodiment of a volleyball hitting practice system 200. The system 200 includes frame 230, practice net 210, catch net 220, suspended ball assembly 260, and speed sensor and indicator 190. The practice net 210 and catch net 220 are attached to frame 230. Frame 230 and can rest on or anchored to a horizontal surface 90. Ball 261 of suspended ball assembly 260 is selectively attached to frame 230 via tether 262. The vertical and horizontal position of ball 261 can be adjusted be either positioning tee fitting 232 along extension arm 231, rotating and fixating tee fitting 233 around top pole 234, or adjusting the length of tether 262. The travel path of ball 261 is shown. When ball 261 is struck, the ball swings along an arc path into catch net 220 where it is deflected and may lose momentum and then eventually returns to the original suspended ball position due to gravity. The speed sensor and indicator 190 can detect the speed of the ball 261 as it travels along the arc in the field of view of the sensor. The length of tether 262 can be between 6 inches and 36 inches. Longer tethers allow the ball to travel farther and over a longer duration in a direction significantly along the line of sight 194 of the electronic ball sensor and indicator 190.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Without further elaboration, it is believed that one skilled in the art can use the preceding description to utilize the present disclosure to its fullest extent. The examples and embodiments disclosed herein are to be construed as merely illustrative and not a limitation to the scope of the present disclosure in any way. It will be apparent to those having skill in the art that changes may be made to the details of the above-described embodiments without departing from the underlying principles of the disclosure described herein. In other words, various modifications and improvements of the embodiments specifically disclosed in the description above are within the scope of the appended claims. Note that elements recited in means-plus-function format are intended to be construed in accordance with 35 U.S.C. §112 ¶6. The scope of the disclosure is therefore defined by the following claims.

The invention claimed is:

1. A volleyball hitting practice system comprising:

a frame having a plurality of support members;

a practice net attached to at least two of the support members;

a ball suspended from the frame by a tether;

wherein the practice net has a planar surface that is substantially vertical and a top edge that is substantially horizontal;

wherein the ball is selectively positionable at a height at or above the top edge of the practice net;

and a catch net attached to the frame;

wherein the catch net extends above the highest portion of the practice net.

2. The volleyball hitting practice system of claim 1, wherein the ball is suspended from the frame using a plurality of tethers.

3. The volleyball hitting practice system of claim 1, wherein the ball can be selectively positioned at a transverse distance away from the plane of the practice net.

4. The volleyball hitting practice system of claim 2, wherein the resistance to moving the ball initially from the suspended position transversely to the planar surface is less than 5 pounds.

5. The volleyball hitting practice system of claim 2, wherein the resistance to moving the ball initially from the suspended position transversely to the planar surface is less than 1 pound.

6. The volleyball hitting practice system of claim 1, additionally comprising an electronic speed sensor attached to the support frame.

7. The volleyball hitting practice system of claim 6, wherein the ball can travel a distance over a period of time that allows the speed sensor to detect and generate an electronic signal in response to the rate of travel of the ball.

8. The volleyball hitting practice system of claim 7, wherein the speed sensor provides the electronic signal to a visual display indicating ball speed information to a player using the system.

9. The volleyball hitting practice system of claim 6, wherein the frame is positioned on a horizontal surface;

and wherein the speed sensor is attached to an extension member that can be selectively detached from the support frame at a height of less than 7 feet from the horizontal surface.

10. The volleyball hitting practice system of claim 1, wherein the practice net is smaller than the catch net and the catch net has a concave region.

11. A volleyball training apparatus comprising:

a frame for positioning on a horizontal surface having a plurality of support members;

a practice net attached to and extended between at least two of the support members;

and a catch net attached to and extended between at least three of the support members;

wherein the practice net has a substantially vertical planar surface and a top edge that is substantially horizontal;

wherein the practice net is smaller than the catch net and the catch net has a concave region that extends vertically above the top edge.

12. The volleyball hitting practice system of claim 11, wherein a volleyball traveling over the practice net and into the concave region of the catch net is deflected downward for facilitating retrieval of the volleyball.

13. The volleyball hitting practice system of claim 12, wherein the volleyball exits the system within 5 feet behind the planar surface from the direction the volleyball entered the system.

14. The volleyball hitting practice system of claim 12, wherein the volleyball is retained in the system and selectively removed.

15. The volleyball hitting practice system of claim 11, additionally comprising an electronic speed sensor attached to the support frame.

16. A volleyball hitting practice system comprising:

a frame having a plurality of support members;

a practice net attached to and extended between at least two of the support members;

a catch net attached to and extended between at least two of the support members;

a speed sensor attached to the support frame;

a visual display;

wherein the practice net has a substantially vertical planar surface and a top edge that is substantially horizontal;

wherein the speed sensor provides a signal to the visual display for indicating information about a ball traveling above the top edge and generally transverse to the planar surface of the practice net and where the ball can be received by the catch net.

17. The volleyball hitting practice system of claim 16, wherein the speed sensor is positioned on the opposite side of the catch net from the planar surface of the practice net.

18. The volleyball hitting practice system of claim 16, wherein the practice net is smaller than the catch net and the catch net has a concave region that extends above the top edge of the practice net.

19. The volleyball hitting practice system of claim 18, wherein a volleyball traveling above the top edge of the practice net is deflected downward by the catch net for facilitating retrieval of the volleyball.

20. The volleyball hitting practice system of claim 19, wherein the volleyball exits the system near the planar surface of the practice net or generally toward the direction from which the volleyball entered the system.

21. The volleyball hitting practice system of claim 19, wherein the volleyball is retained in the system and selectively removed.

22. The volleyball hitting practice system of claim 16, wherein the frame is positioned on a horizontal surface;

and wherein the speed sensor is attached to an extension member that can be selectively detached from the frame at a height of less than 7 feet from the horizontal surface.

23. A volleyball hitting practice system comprising:

a frame having a plurality of support members;

a practice net attached to and extended between at least two of the support members;

a catch net attached to and extended between at least two of the support members;

a ball suspended from the frame by a tether;

a speed sensor attached to the support frame;

and a visual display;

wherein the practice net has a substantially vertical planar surface and a top edge that is substantially horizontal;

wherein the ball can travel at least 12 inches and over a period of time that allows the speed sensor to detect and generate a signal in response to the rate of travel of the ball;

and wherein the speed sensor provides the signal to a visual display indicating rate of travel information to a player using the system.

* * * * *